United States Patent [19]

Millard et al.

[11] 4,124,906

[45] Nov. 14, 1978

[54] CHILD'S CRIB FOR USE IN A POOL

[75] Inventors: Martha F. Millard, Poughkeepsie; Richard A. Gorges, Hyde Park, both of N.Y.

[73] Assignee: Raymond Lee Organization, Inc., New York, N.Y.

[21] Appl. No.: 743,717

[22] Filed: Nov. 22, 1976

[51] Int. Cl.[2] ..... E04H 3/16; E04H 3/19

[52] U.S. Cl. ..... 4/172; 5/99 C; 4/1; 5/100

[58] Field of Search ..... 4/1, 171, 172, 185, 4/11; 5/93, 95, 97–99, 100

[56] References Cited

U.S. PATENT DOCUMENTS

| | | | |
|---|---|---|---|
| 1,277,292 | 8/1918 | Checkley | 5/95 |
| 2,544,428 | 3/1951 | Judy | 5/95 |
| 2,569,555 | 10/1951 | Chanslor et al. | 5/95 |
| 2,574,559 | 11/1951 | Graf et al. | 5/11 |
| 3,813,703 | 6/1974 | Beaudin, Jr. | 5/98 R |
| 3,874,005 | 4/1975 | Badon | 4/171 |

*Primary Examiner*—Casmir A. Nunberg
*Attorney, Agent, or Firm*—Stephen Wyden

[57] ABSTRACT

A set of round support weights connected by a hollow horizontal bottom support having perforations so that the bottom support can fill with water and not be buoyant can be connected to a crib by vertical supports engaging corner vertical rails of the crib, the crib consisting of an upper rail, a bottom rail and vertical rails connecting the upper and bottom rails with a floor clamped to a bottom of the bottom rail. A set screw can secure the corner vertical rails to the upright supports and adjustable coping locks attached to diagonally opposite corners of the upper rails of the crib can secure the upper rails of the crib to a coping of a pool, so children of different ages may be able to use a pool while their parents are free to use the pool at the same time.

3 Claims, 4 Drawing Figures

CHILD'S CRIB FOR USE IN A POOL

We have invented a child's crib for use in a pool. This device will be of particular value for children in the age range of 9 months to approximately 4 years and should be made of a water and chlorine proof material. Our improved child's crib can be adjusted up and down within the water to accommodate the various ages of the child safely. Still further, it is to be noted that by the use of smoothe round feet at the base of the crib supports this child's crib may be used in pools with liners with greatly reduced danger of cutting the liner.

Our invention can be understood in view of the accompanying figures.

Figure 1:
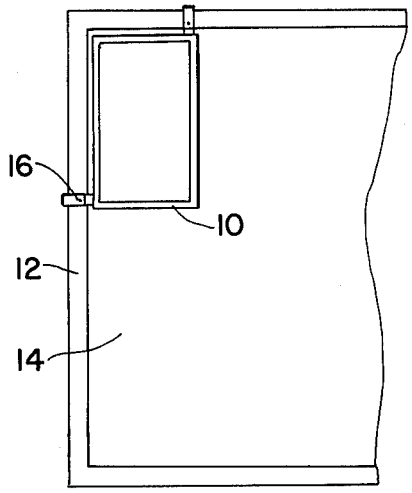
FIG. 1 is a top view of the device in use.
Figure 2:
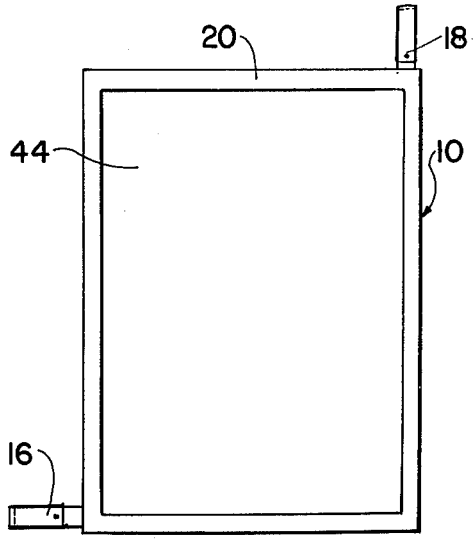
FIG. 2 is a top view of the device by itself.
Figure 4:
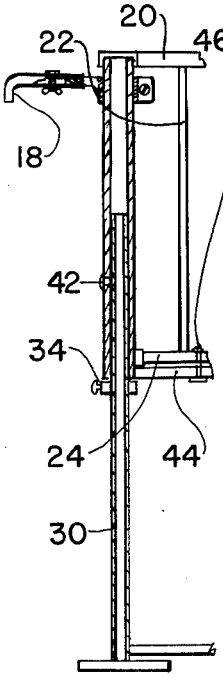
FIG. 4 is a side view of an edge portion of the device seen in FIG. 3.
Figure 3:
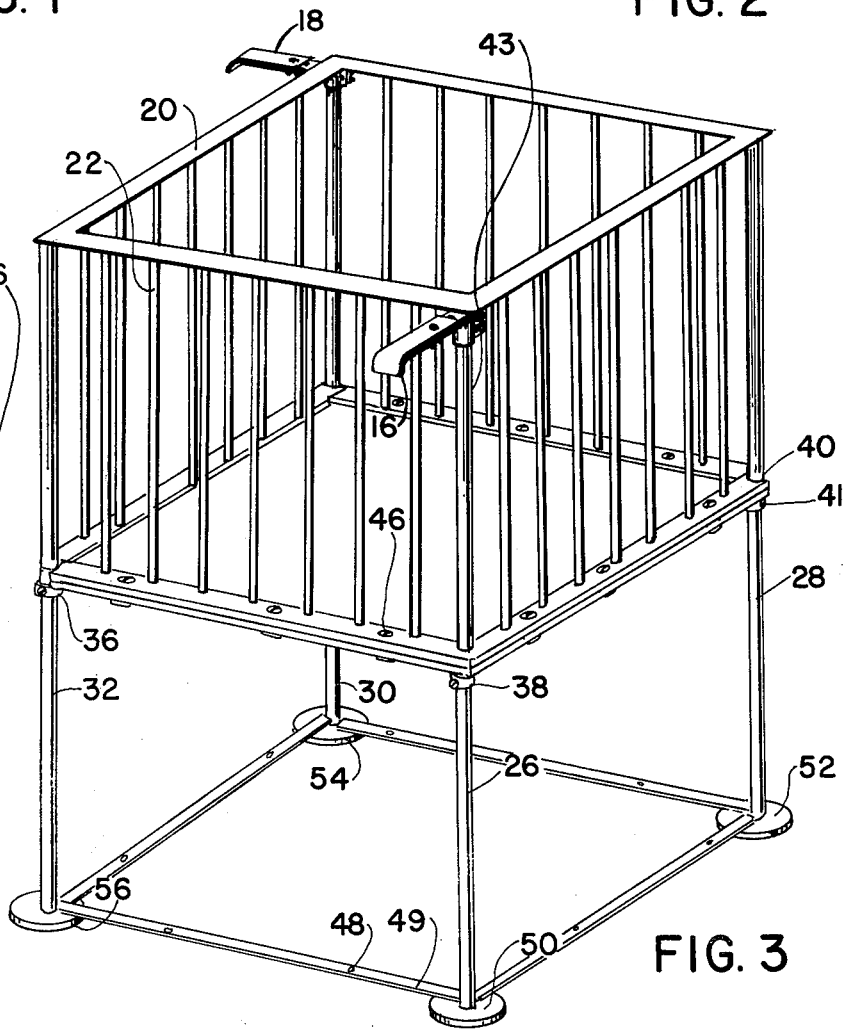
FIG. 3 is a perspective side view of the device.

With regard to FIGS. 1, 2, 3, and 4, an improved child's crib 10 can be attached to a corner of the upper coping of a pool 12 and the crib 10 can be suspended within the water 14 of the pool so that a child may be in the crib and also be in the water at the same time. Adjustable coping locks 16 and 18 can attach at diagonally opposite corners of the crib 10 to the sides of the coping 12 of the pool. The upper rails 20 of the crib 10 can be connected by vertical members 22 or rails to the lower rails 24. The lower rail 24 can be secured to a set of support rods 26 28 30 and 32 by a set of collars 34 36 38 and 40 which can be secured to the uprights 26 28 30 and 32 by wing nuts and bolts such as 41. The position of the bottom rail 24 on the upright supports 26 28 30 and 32 determines the depth of water within the crib 10 and thereby determines the age of the child to be accommodated in the crib 10. A set screw 42 can also be used to secure the corner uprights such as 43 to the support members such as 26. The floor 44 can be secured to the bottom rail 24 by a set of clamps 46 mounted around the bottom periphery of the lower rail 24 and around the outer periphery of the floor 44. Perforations 48 in the bottom support layer 49 can permit water to enter the bottom support 49 so that the crib supports 49 will not be buoyant. Round pads of a weighted nature 50 52 54 and 56 at the corners of the bottom support members 49 can further anchor the crib 10 to the bottom of the pool and thereby stabilize the pool while in use by a child.

Having described a preferred embodiment of our invention, it is understood that various changes can be made without departing from the spirit of our invention, and we desire to cover by the appended claims all such modifications as fall within the true spirit and scope of my invention.

What I claim and seek to secure by Letters Patent is:

1. A child's crib for use in a pool, comprising:
   - a crib,
   - the crib adjustably attachable to a bottom support,
   - the bottom support positionable in a portion of a pool,
   - a top of the crib attachable to a coping of the pool,
   - the bottom support having a roundweighted pad attached to a corner of each of a plurality of bottom support members,
   - an equal plurality of vertical support members each attached to one of the pads,
   - the bottom support members forming a plurality of perforations connected to a hollow portion of each bottom support member, whereby the hollow support members may fill with water to reduce buoyancy of the support members,
   - the crib having an upper rail,
   - vertical rails attached to the upper rail,
   - a bottom rail attached to a bottom portion of each of the vertical rails,
   - a floor attached to a bottom of the bottom rail by a plurality of clamps, and
   - diagonally opposite edges of the upper rail attached to adjacent sides of the pool coping by an adjustable coping lock attached to each of the opposite upper rail edges.

2. The crib of claim 1, wherein each of the vertical supports is slidingly receivable in a shaftway in one of the corner vertical rails of the crib, and an adjustable collar attachable to one of the upright supports positions the crib on the upright supports.

3. The crib of claim 2, further comprising:
   - a set screw attachable to one of the corner vertical rails of the crib and engageable with an upper portion of one of the upright supports, whereby the crib may be locked in position on the upright supports.

* * * * *